US005974918A

United States Patent [19]

Nakagawa et al.

[11] Patent Number: 5,974,918

[45] Date of Patent: Nov. 2, 1999

[54] SCREW DRIVING DEVICE

[75] Inventors: Atsushi Nakagawa, Hitachinaka; Chikai Yoshimizu, Ibaraki-ken; Kouichirou Yamada, Hitachinaka, all of Japan

[73] Assignee: Hitachi Koki Co., Ltd., Tokyo, Japan

[21] Appl. No.: 08/834,841

[22] Filed: Apr. 10, 1997

[30] Foreign Application Priority Data

Apr. 18, 1996 [JP] Japan ..... 8-096650

[51] Int. Cl.[6] ..... B25B 23/04

[52] U.S. Cl. ..... 81/434; 81/57.37

[58] Field of Search ..... 81/434, 435, 57.37, 81/37, 431

[56] References Cited

U.S. PATENT DOCUMENTS

| | | | |
|---|---|---|---|
| 3,554,246 | 1/1971 | Halstead | 81/434 |
| 4,059,034 | 11/1977 | Hornung . | |
| 4,146,071 | 3/1979 | Muller et al. | 81/434 |
| 4,428,261 | 1/1984 | Takatsu et al. . | |
| 5,083,483 | 1/1992 | Takagi | 81/434 |
| 5,167,174 | 12/1992 | Fujiyama et al. | 81/434 |
| 5,402,695 | 4/1995 | Hornung | 81/434 |
| 5,687,624 | 11/1997 | Tsuge et al. | 81/57.37 |

FOREIGN PATENT DOCUMENTS

| | | |
|---|---|---|
| 0593970 | 4/1994 | European Pat. Off. . |
| 6927024 | 7/1969 | Germany . |
| 4208715 | 9/1992 | Germany . |
| 4219095 | 12/1993 | Germany . |

*Primary Examiner*—David A. Scherbel
*Assistant Examiner*—Lee Wilson
*Attorney, Agent, or Firm*—Pollock, Vande Sande & Amernick

[57] ABSTRACT

A screw driving device includes a rotatable driver bit for driving a screw into a workpiece. A motor rotates the driver bit. A rotatable sprocket in engagement with a screw carrying belt feeds the screw carrying belt, and thereby feeds a screw on the screw carrying belt to a drivable place axially aligning with and being in front of the driver bit. A slide member supports the screw carrying belt. The slide member has a hole through which the screw is driven into the workpiece by the driver bit. When the screw is in the drivable place, a distance between the screw and an edge of the hole in a predetermined direction is greater than a distance between the screw and an edge of the hole in a direction different from the predetermined direction.

5 Claims, 10 Drawing Sheets

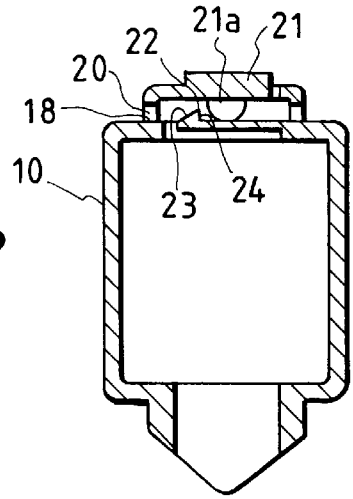
FIG. 12
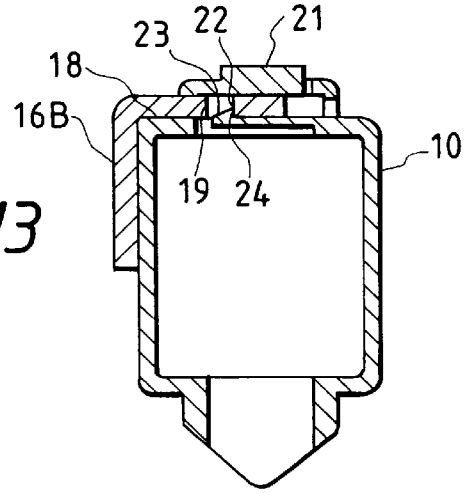
FIG. 13
FIG. 14
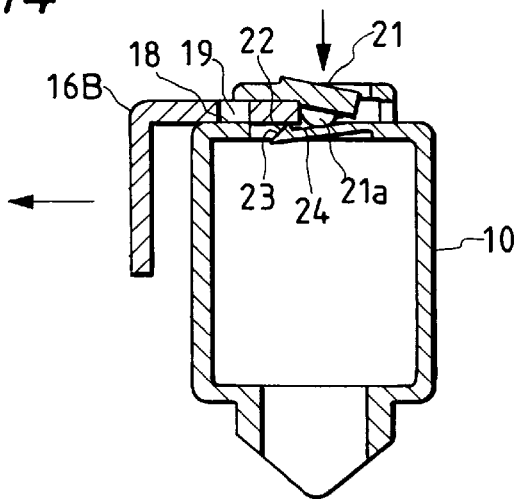

SCREW DRIVING DEVICE

BACKGROUND OF THE INVENTION

1. Field of the Invention

This invention relates to a screw driving device, that is, a device for driving screws into a workpiece.

2. Description of the Related Art

U.S. Pat. No. 4,059,034 discloses a device for driving screws into a workpiece. The screw driving device in U.S. Pat. No. 4,059,034 includes a casing having a slide member which in turn supports an indexing arrangement for indexing a flexible notched belt carrying a plurality of screws. The indexing arrangement serves to index a screw into a screwing station whenever the device is operated. The index arrangement includes sprocket discs, the teeth of which engage the notched belt. Movement of the indexing arrangement to index the belt through one pitch is controlled by a coupling movable under the control of a pin slidable in an elongate aperture or recess in the casing of the device. A plurality of springs is employed to return the slide member to its inoperative condition at the end of each working cycle.

SUMMARY OF THE INVENTION

It is an object of this invention to provide an improved screw driving device.

A first aspect of this invention provides a device for sequentially driving screws carried on a screw carrying belt which comprises a rotatable driver bit for driving a screw into a workpiece; a motor for rotating the driver bit; a rotatable sprocket in engagement with the screw carrying belt for feeding the screw carrying belt and for feeding a screw on the screw carrying belt to a drivable place axially aligning with and being in front of the driver bit; and a slide member for supporting the screw carrying belt, the slide member having a hole through which the screw is driven into the workpiece by the driver bit; wherein when the screw is in the drivable place, a distance between the screw and an edge of the hole in a predetermined direction is greater than a distance between the screw and an edge of the hole in a direction different from the predetermined direction.

A second aspect of this invention is based on the first aspect thereof, and provides a device wherein the predetermined direction agrees with a direction of feed of the screw carrying belt by the sprocket.

A third aspect of this invention is based on the second aspect thereof, and provides a device wherein the predetermined direction agrees with a direction of outgoing movement of the screw carrying belt.

A fourth aspect of this invention is based on the first aspect thereof, and provides a device further comprising a stopper for stopping a screw on the screw carrying belt at the drivable place, the stopper being provided on the slide member and comprising divided elastic members which engage the screw in the drivable place.

A fifth aspect of this invention provides a device for sequentially driving screws carried on a screw carrying belt which comprises a rotatable driver bit for driving a screw into a workpiece; a motor for rotating the driver bit; a rotatable sprocket in engagement with the screw carrying belt for feeding the screw carrying belt and for feeding a screw on the screw carrying belt to a predetermined drivable place axially aligning with and being in front of the driver bit; and a slide member for supporting the screw carrying belt, the slide member being slidable relative to the driver bit, the slide member having a groove along which bodies of screws on the screw carrying belt travel as the screw carrying belt is fed by the sprocket; wherein the groove has a first portion and a second portion in communication with each other, and screws on the screw carrying belt move from the first portion to the second portion as the screw carrying belt is fed by the sprocket; and wherein an edge region of the second portion which adjoins the first portion contains the predetermined drivable place of the screw, the second portion being elongated from the edge region along a direction of feed of the screw carrying belt by the sprocket, the second portion being greater in width than the first portion.

A sixth aspect of this invention is based on the fifth aspect thereof, and provides a device further comprising a stopper for stopping a screw on the screw carrying belt at the predetermined drivable place, the stopper being provided on the slide member and comprising divided elastic members which engage the screw in the predetermined drivable place.

BRIEF DESCRIPTION OF THE DRAWINGS

FIG. 12 is a sectional view of a part of the screw driving device, from which an adaptor is separate, taken along the line E—E of FIG. 11.

FIG. 13 is a sectional view, similar to FIG. 12, of a part of the screw driving device into which an adaptor is inserted.

FIG. 14 is a sectional view, similar to FIG. 12, of a part of the screw driving device from which an adaptor is partially removed.

DESCRIPTION OF THE PREFERRED EMBODIMENTS

Figure 1:
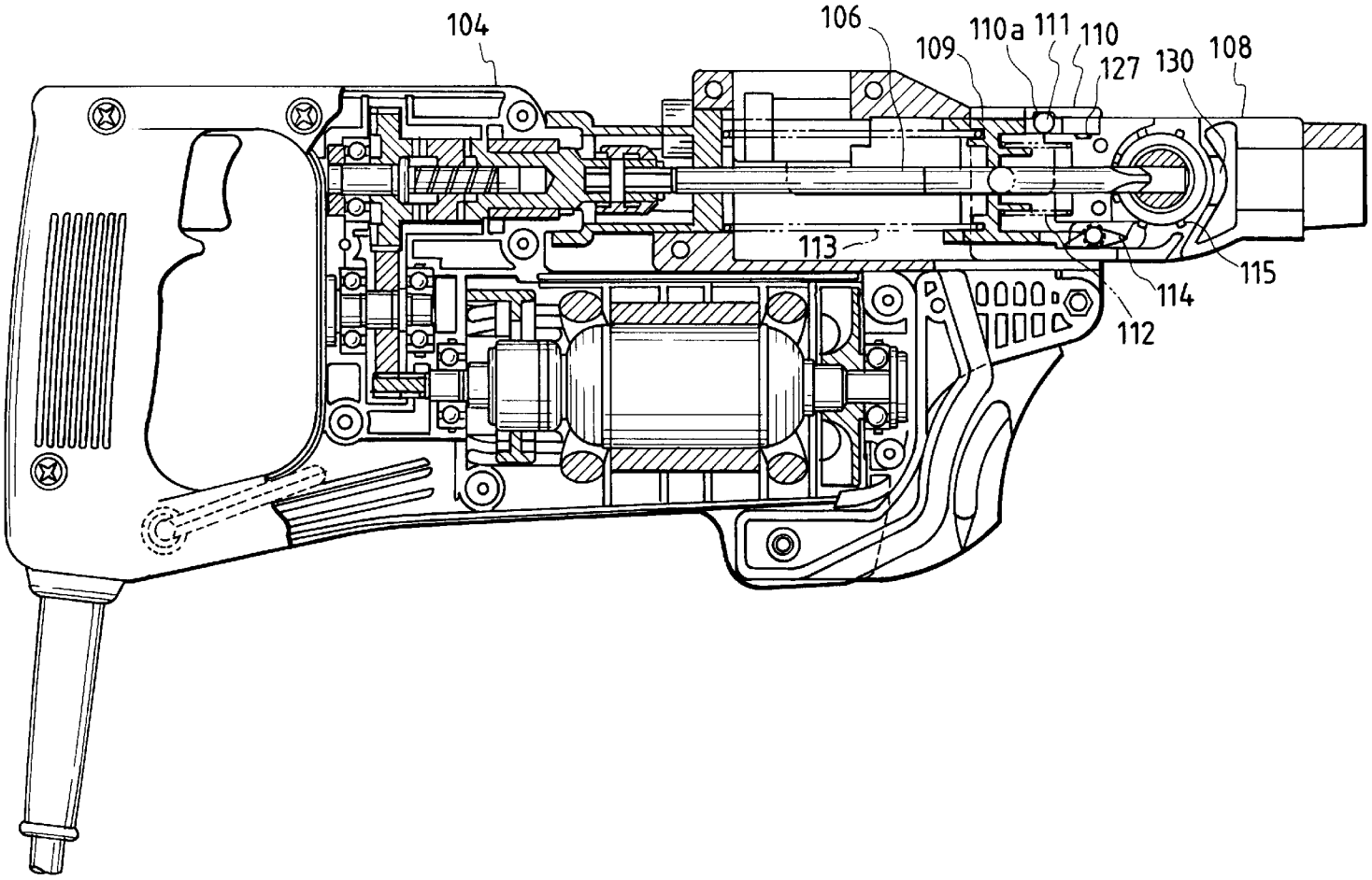
FIG. 1 PRIOR ART
FIG. 1 is a longitudinal section view of a prior-art screw driving device.
Figure 2:
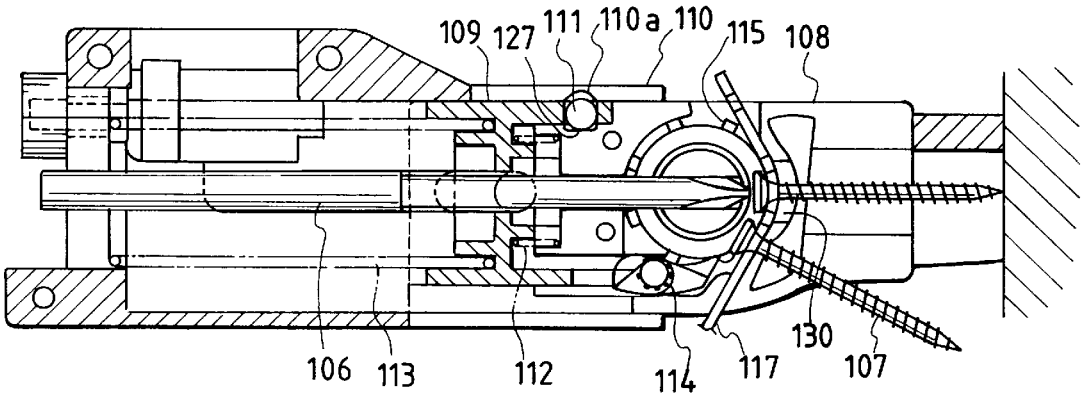
FIG. 2 PRIOR ART
FIG. 2 is a sectional view of a part of the prior-art screw driving device in FIG. 1.

A prior-art screw driving device will be explained for a better understanding of this invention. FIGS. 1 and 2 show the prior-art screw driving device.

With reference to FIGS. 1 and 2, the prior-art screw driving device includes a body 104 having a front end provided with a first slide member 108. A spring 112 urges the first slide member 108. As the operator presses the device body 104 frontward against a workpiece, the first slide member 108 is relatively moved into a casing 110 so that a sprocket 115 in the first slide member 108 is rotated by operation of a feed claw 114 on a second slide member 109. The sprocket 115 engages a screw carrying belt 117 made of resin on which a row of screws 107 is supported. The rotation of the sprocket 115 moves the screw carrying belt 117, thereby feeding a screw 107 on the belt 117 to a given position (a drivable position). The casing 110 forms a part of the body 104. The second slide member 109 is urged by a spring 113. The second slide member 109 has a space for accommodating a roller 111 which can partially enter an engagement groove 11*a* in the casing 110. Accordingly, the second slide member 109 can engage the casing 110 via the roller 111.

When the screw 107 on the belt 117 is fed to the given position (the drivable position) and the first slide member 108 contacts the second slide member 109, the roller 111 travels to a groove 127 in the first slide member 108 and thus falls into the groove 127 out of the engagement groove 110*a* in the casing 110. Therefore, the second slide member 109 moves out of engagement with the casing 110. Then, the first slide member 108 and the second slide member 109 are moved together along a rearward direction relative to the casing 110.

In the prior-art screw driving device of FIGS. 1 and 2, as the first slide member 108 and the second slide member 109 are moved rearward, a driver bit 106 and the screw 107 on the belt 117 come into engagement with each other. The screw carrying belt 117 is pressed against the first slide member 108 in accordance with rearward movement of the first slide member 108. Thus, the screw carrying belt 117 is deformed along a circular hole 130 in the first slide member 108 through which the screw 107 in the given position (the drivable position) extends. When the screw carrying belt 117 is deformed to a certain degree, the screw 107 separates from the belt 117. Then, the screw 107 is driven into the workpiece by the driver bit 106. Generally, after the screw 107 has been completely driven into the workpiece, the operator separates the device body 104 from the workpiece. When the device body 104 is separate from the workpiece, the springs 112 and 113 return the first slide member 108 and the second slide member 109 to their initial positions.

In the prior-art screw driving device of FIGS. 1 and 2, during the separation of the screw 107 from the belt 1 17, the screw 107 tears a related part of the belt 117. To facilitate the separation of the screw 107 from the belt 117, the belt 117 has radially-extending cuts around the screw 107. After the screw 107 has been completely driven into the workpiece, the screw carrying belt 117 remains at the back side of the first slide member 108 and maintains engagement with the sprocket 115. In the case of each screw 107 having a head diameter of 6 to 9 mm, the circular hole 130 in the first slide member 108 has a diameter of 10 to 12 mm. During the separation of the screw 107 from the belt 117, a portion of the belt 117 is deformed into a conical shape while being pressed between the head of the screw 107 and the walls of the first slide member 108 around the circular hole 130. In other words, the portion of the belt 117 is deformed by a load. The separation of the screw 107 from the belt 117 is enabled by a load of, for example, 10 to 12 kg. This means that the operator is required to generate a relatively great force when pressing the device body 104 against the workpiece.

In the prior-art screw driving device of FIGS. 1 and 2, when the workpiece is a gypsum board, gypsum dust (gypsum powder) tends to enter clearances among the casing 110, the first slide member 108, and the second slide member 109. Gypsum dust in the clearances increases frictional resistances to relative movement among the casing 110, the first slide member 108, and the second slide member 109. The increased frictional resistances cause the roller 111 to be subjected to an increased load by the first slide member 108, the second slide member 109, and the casing 110. In the case where such a load on the roller 111 overcomes the force of engagement between the roller 111 and the casing 110, the second slide member 109 tends to start rearward movement at a timing earlier than the normal timing. In this case, the roller 111 is fixed between the first slide member 108 and the casing 110 so that the first slide member 108 and the second slide member 109 are locked. The locking of the first slide member 108 and the second slide member 109 makes it difficult to feed the screw carrying belt 117. Also, after a screw 107 has been completely driven into the workpiece, the roller 111 tends to be fixed between the first slide member 108 and the second slide member 109 so that the first slide member 108 and the second slide member 109 can not return to their initial positions. Increased forces of the springs 112 and 113 are able to compensate for increases in the frictional resistances to relative movement among the casing 110, the first slide member 108, and the second slide member 109. The operator is required to generate a greater force when pressing the device body 104 against the workpiece as the forces of the springs 112 and 113 are increased.

In the prior-art screw driving device of FIGS. 1 and 2, when the workpiece is a gypsum board, gypsum dust tends to enter the engagement groove 110*a* in the casing 110. When the engagement groove 110*a* is fully filled with gypsum dust, the roller 111 can not return to its initial position.

In the prior-art screw driving device of FIGS. 1 and 2, the sprocket 115 is rotated by the feed claw 114 on the second slide member 109, and the screw carrying belt 117 is fed in accordance with the rotation of the sprocket 115. Accordingly, if the operator generates an excessively strong force when pressing the device body 104 against the workpiece or the operator excessively quickly presses the device body 104 against the workpiece, the sprocket 115 overruns or the screw 107 is over-driven into the workpiece.

First Embodiment

Figure 3:
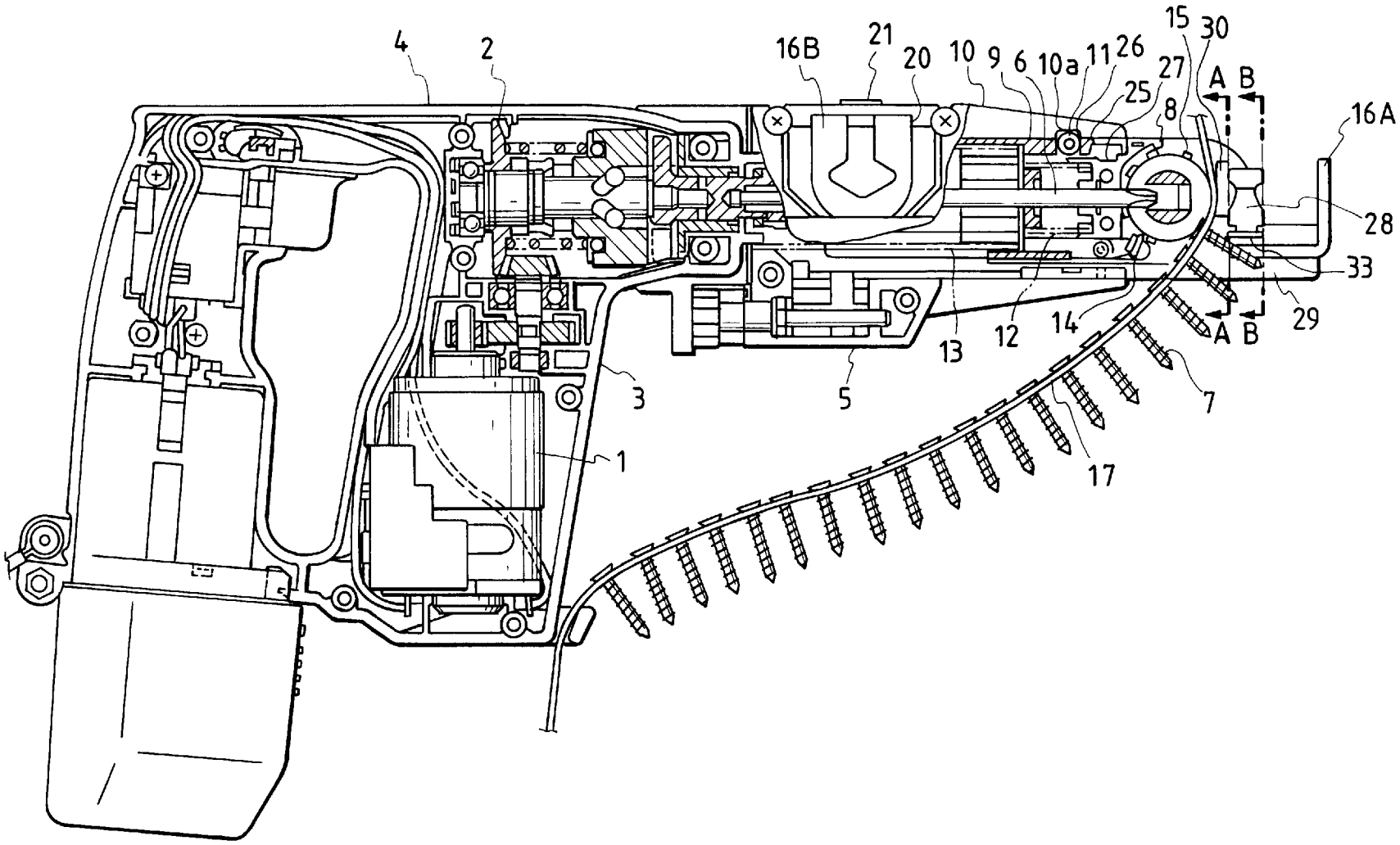
FIG. 3 is a longitudinal section view of a screw driving device according to a first embodiment of this invention.

With reference to FIG. 3, a screw driving device includes a motor 1 generating a rotational force. The rotational force is transmitted from the motor 1 to a driver bit 6 via a speed reduction gear mechanism 2. Thus, the driver bit 6 can be rotated by the motor 1.

The screw driving device of FIG. 3 includes a device body 4 having a housing 3 which accommodates the motor 1 and the speed reduction gear mechanism 2. The housing 3 has a front end or a head provided with a feeder assembly 5. A row of screws 7 is supported on a screw carrying belt 17 made when, for example, resin. The feeder assembly 5 has a screw feeding mechanism which sequentially feeds the screws 7 on the belt 17 to a predetermined position (a drivable position) directly facing a front end of the driver bit 6. Specifically, the predetermined position (the drivable position) of the screw 7 axially aligns with and is in front of the driver bit 6.

The feeder assembly 5 includes a first slide member 8 within which a sprocket 15 is rotatably disposed. The first slide member 8 movably extends into a casing 10 fixed to the front end of the housing 3. The sprocket 15 has teeth engageable with notches in the screw carrying belt 17. Thus, the screw carrying belt 17 is fed as the sprocket 15 rotates.

Figure 4:
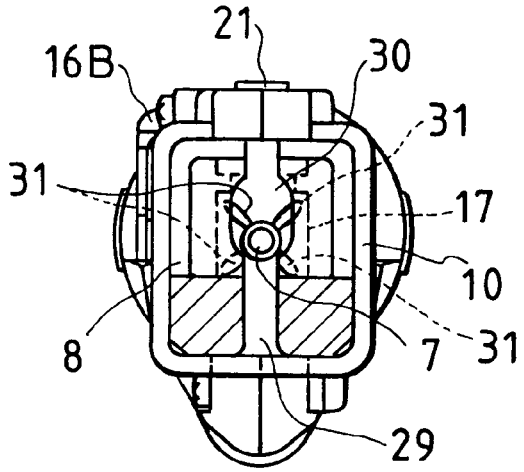
FIG. 4 is a sectional view of the screw driving device taken along the line A—A of FIG. 3.

As shown in FIGS. 3 and 4, a front part of the first slide member 8 has a slot or a groove which forms screw passages 29 and 30. The screw passage 30 extends in a central part of the screw passage 29. The screw passage 30 is greater in width than the screw passage 29. Screws 7 on the belt 17 are fed along the screw passage 29. Before each screw 7 is driven into a workpiece, the screw 7 is fed via the screw passage 29 to a given position (a drivable position) within the screw passage 30. During the driving of each screw 7 into a workpiece, the screw 7 is forced longitudinally or axially through the screw passage 30. The screw passage 29 has a width of, for example, about 5 to about 6 mm. As shown in FIG. 4, the screw passage 30 has semicircular concave opposing edge regions. The screw passage 30 is elongated between the semicircular edge regions along a direction of the feed of the screw carrying belt 17. The semicircular edge regions of the screw passage 30 adjoin the screw passage 29. One of the semicircular edge regions of the screw passage 30, which assumes a lower position as viewed in FIG. 4, is approximately coaxial with the driver bit 6. In other words, the lower semicircular edge region of the screw passage 30 approximately axially aligns with the driver bit 6. Also, the lower semicircular edge region is in front of the driver bit 6. The given position (the drivable position) of the screw 7 is contained in the lower semicircular edge region of the screw passage 30. Each of the semicircular edge regions of the screw passage 30 has a diameter of, for example, about 10 to about 11 mm. As previously explained, the screw passage 30 extends between the semicircular edge regions, being elongated in the direction of the feed of the screw carrying belt 17. The screw passage 30 has a width corresponding to the width or the diameter of the semicircular edge regions.

Figure 5:
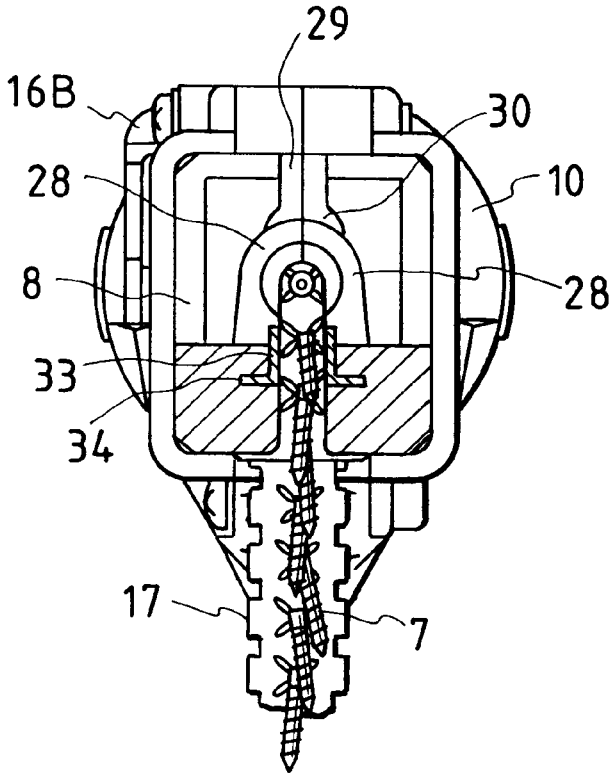
FIG. 5 is a sectional view of the screw driving device taken along the line B—B of FIG. 3.

As shown in FIGS. 3 and 5, the portion of the first slide member 8 in front of the sprocket 15 is provided with a pair of stoppers 28 including elastic members. Normally, the stoppers 28 are in engagement with each other. The stoppers 28 extend at a right-hand side and a left-hand side of the axis of the driver bit 6, respectively. The stoppers 28 are made of, for example, rubber. Each of the stoppers 28 has an inverted J shape as viewed in FIG. 5. The stoppers 28 are fixed to respective L-shaped metal members 33 by, for example, a baking process. The L-shaped metal members 33 are pressed into grooves 34 in the first slide member 8, respectively. The stoppers 28 extend in front of the sprocket 15 by a space such that they can receive the head of each screw 7 regardless of the length of the screw 7.

The stoppers 28 form a guide groove whose base portion has a width approximately equal to the width of the screw passage 29. The guide groove in the stoppers 28 has an end conforming to a part of the body of a screw 7. The size of the end of the guide groove corresponds to a diameter of, for example, about 4 mm.

As shown in FIG. 3, a second slide member 9 is movably disposed in the casing 10. The second slide member 9 is provided with a feed claw 14 for rotating the sprocket 15. The casing 10 has an engagement groove 10*a* into which a roller 11 can move.

Figure 6:
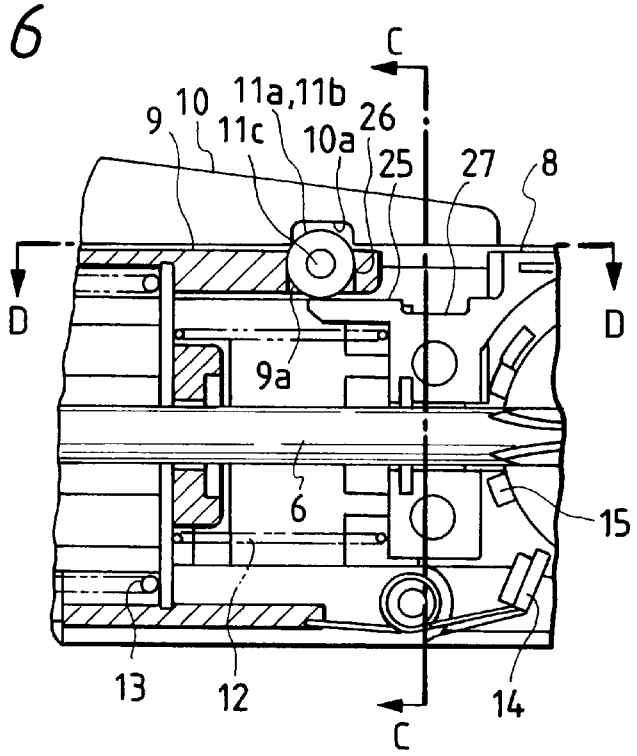
FIG. 6 is a sectional view of a part of the screw driving device in FIG. 3.
Figure 7:
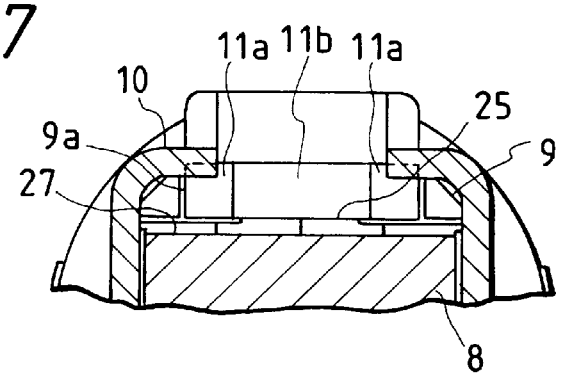
FIG. 7 is a sectional view of the screw driving device taken along the line C—C of FIG. 6.
Figure 8:
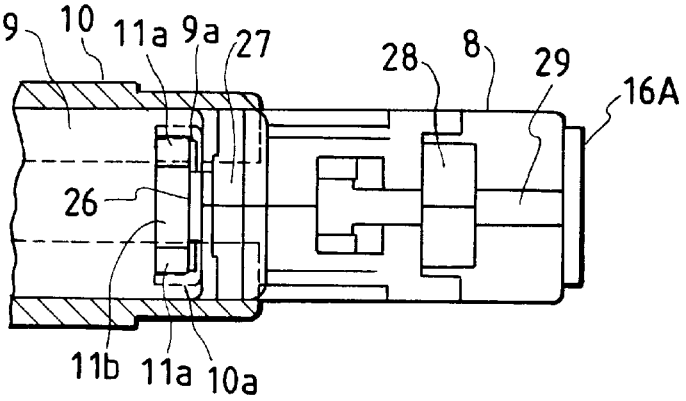
FIG. 8 is a sectional view of the screw driving device taken along the line D—D of FIG. 6.

As shown in FIGS. 6, 7, and 8, the roller 11 has a needle 11*c* and three cylindrical members 11*a* and 11*b*. The three cylindrical members 11*a* and 11*b* are coaxially provided on the needle 11*c*. The cylindrical members 11*a* and 11*b* are rotatable about the needle 11*c* independently of each other. The cylindrical members 11*a* are located at opposite sides of the cylindrical member 11*b*. Thus, the cylindrical members 11*a* are referred to as the side cylindrical members while the cylindrical member 11*b* is referred to as the central cylindrical member. A spring 12 disposed in the casing 10 serves to urge the first slide member 8 and the second slide member 9 away from each other. A spring 13 disposed in the casing 10 urges the second slide member 9 relative to the casing 10 along a frontward direction. The springs 12 and 13 cooperate to enable the first slide member 8 to project frontward from the casing 10 when the screw driving device is separate from a workpiece.

Screws 7 are of various types having lengths in the range of, for example, about 20 mm to about 50 mm. It is preferable that the distal end of a screw 7 is spaced from a workpiece by a distance of, for example, about 3 mm to about 7 mm before the start of a screw driving process. Any one of plural adaptors having different sizes can be detachably connected to the front end of the first slide member 8. The plural adaptors are designed for the different types of screws 7, respectively. The plural adaptors include adaptors 16A and 16B. In FIG. 3, the adaptor 16A is connected to the front end of the first slide member 8 while the adaptor 16B is retained by an adaptor hold section 20 provided on the casing 10.

Figure 9:
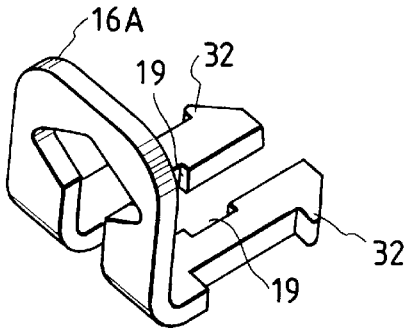
FIG. 9 is a perspective view of an adaptor which can be attached to and placed in the screw driving device in FIG. 3.

As shown in FIG. 9, the adaptor 16A has an L-shaped member forking into two portions. The adaptor 16A is made from a steel plate by, for example, press molding. An end of the adaptor 16A has projections 32. Inner sides of the two portions of the adaptor 16A have grooves 19. The adaptor 16A is elastically deformed from its original shape and is placed to a given position relative to the first slide member 8 when being attached to the adaptor 16A. The elastic deformation enables the adaptor 16A to remain in the given position relative to the slide member 8. To connect and detach the adaptor 16A to and from the first slide member 8, it is sufficient to apply a weak force to the adaptor 16A.

Figure 10:
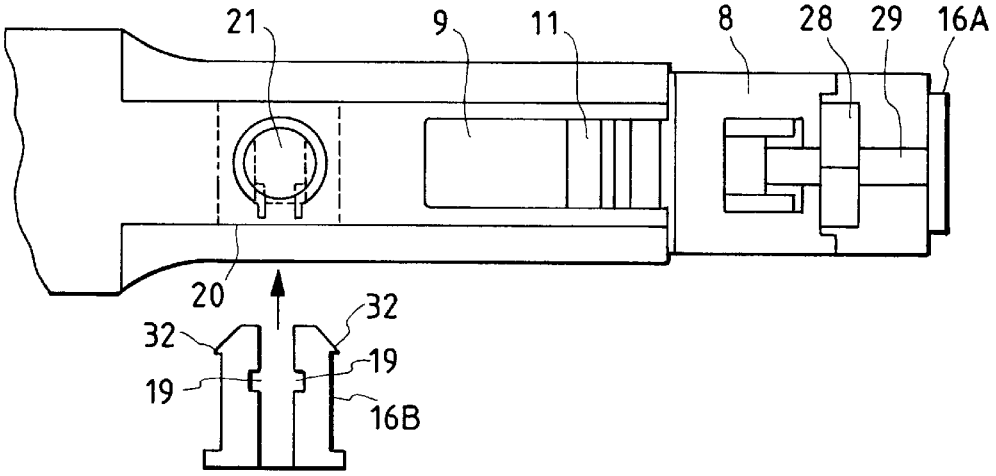
FIG. 10 is a top view of a part of the screw driving device in FIG. 3 from which an adaptor is separate.
Figure 11:
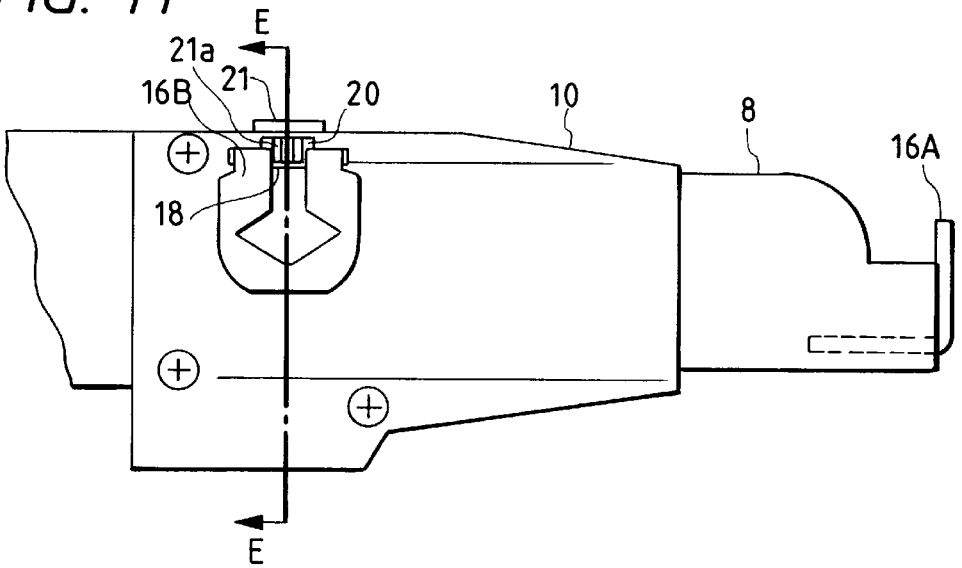
FIG. 11 is a side view of a part of the screw driving device in FIG. 3 into which an adaptor is placed.

As shown in FIGS. 10, 11, and 12, the adaptor hold section 20 is provided on a side surface of the casing 10. An upper part of the adaptor hold section 20 has a button 21 formed with a downward projection 21*a*. A lower part of the adaptor hold section 20 has an elastically movable wall formed with a projection 22. The projection 21*a* on the button 21 can engage the elastically movable wall of the lower part of the adaptor hold section 20. The adaptor hold section 20 has a lower surface 18 from which the projection 22 can emerge.

As shown in FIG. 12, a first side of the projection 22 has a gentle slope surface 23. A second side of the projection 22 which is opposite to the first side thereof has an engagement portion 24. The engagement portion 24 can engage the portions of the adaptor 16A (or 16B) which define the grooves 19.

To place the adaptor 16B (or 16A) at the adaptor hold section 20, the adaptor 16B (or 16A) is inserted thereinto. During the insertion of the adaptor 16B into the adaptor hold section 20, the adaptor 16B is guided by the lower surface 18 of the adaptor hold section 20. As the adaptor 16B is inserted into the adaptor hold section 20, the adaptor 16B meets the slope surface 23 of the projection 22 and then moves down the projection 22 by the engagement between the adaptor 16B and the slope surface 23. As shown in FIG. 13, when the grooves 19 in the adaptor 16B reach the position of the projection 22, the projection 22 moves up into the grooves 19 so that the engagement portion 24 of the projection 22 comes into engagement with the portions of the adaptor 16B which define the grooves 19. Thus, the adaptor 16B (or 16A) is retained in position by the adaptor hold section 20.

As shown in FIG. 14, to remove the adaptor 16B (or 16A) from the adaptor hold section 20, the button 21 is depressed so that the wall of the lower part of the adaptor hold section 20 is moved down by the projection 21 on the button 21. Thus, the projection 22 on the wall of the lower part of the adaptor hold section 20 is moved down out of the the grooves 19 in the adaptor 16B, and the projection 22 is disconnected from the adaptor 16B. Then, the adaptor 16B is pulled away from the adaptor hold section 20 until being completely separate therefrom. In this way, the adaptor 16B (or 16A) is removed from the adaptor hold section 20.

It is preferable that the button 21 and the projection 22 are integrally made of plastic resin.

The screw driving device of FIG. 3 operates as follows. When the operator presses the device body 4 against a workpiece, the first slide member 8 is moved rearward into the casing 10 against the force of the spring 12. As the first slide member 8 is moved rearward, the sprocket 15 is rotated by the feed claw 14 on the second slide member 9. The rotation of the sprocket 15 moves the screw carrying belt 17 so that a screw 7 on the belt 17 is fed to a given position (a drivable position) directly facing the front end of the driver bit 6. During this period, the body of the screw 7 on the belt 17 moves to the screw passage 30 via the screw passage 29 in the first slide member 8. Until the screw 7 on the belt 17 is fed to the given position within the screw passage 30 which directly faces the front end of the driver bit 6, the second slide member 9 and the casing 10 remain in engagement with each other via the roller 11. The given position (the drivable position) of the screw 7 axially aligns with and is in front of the driver bit 6.

As shown in FIGS. 6, 7, and 8, when the second slide member 9 and the casing 10 are in engagement with each other via the roller 11, an upper part of the roller 11 enters the engagement groove 10*a* in the casing 10 and the rest of the roller 11 extends in a space 9*a* in the second slide member 9. Specifically, the central cylindrical member 11*b* of the roller 11 contacts a surface 26 of a stepped wall of the second slide member 9 which defines a front side of the space 9*a*. In addition, the central cylindrical member 11*b* is placed on a flat portion 24 of the first slide member 8. On the other hand, the side cylindrical members 11*a* of the roller 11 contact a wall of the casing 10 which defines a rear edge of the engagement groove 10*a*. The walls of the first slide member 8 which define the flat portion 24 are stepped so that the flat portion 24 will be out of contact with the side cylindrical members 11*a* of the roller 11.

Figure 15:
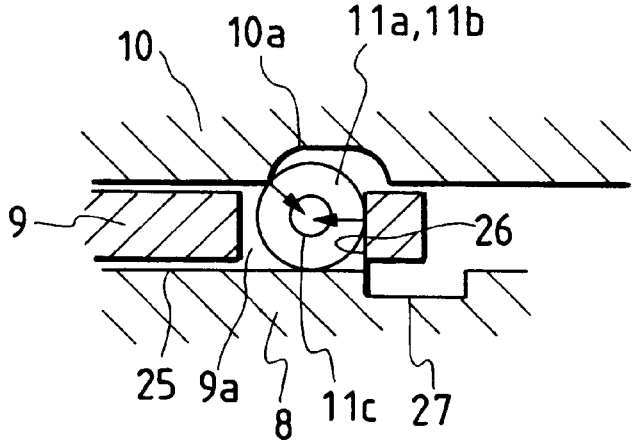
FIG. 15 is a sectional view of a first slide member, a second slide member, a casing, and a roller in the screw driving device of FIG. 3.

As shown in FIG. 15, when the first slide member 8 is moved rearward into the casing 10, the roller 11 receives forces, denoted by arrows, from the casing 10 and the second slide member 9. The force applied to the roller 11 from the casing 10 is in a direction so as to rotate the roller 11 clockwise as viewed in FIG. 15. On the other hand, the force applied to the roller 11 from the second slide member 9 is in a direction so as to move the roller 11 rearward. The side cylindrical members 11*a* of the roller 11 bear the load from the casing 10 while the central cylindrical member 11*b* of the roller 11 bears the load from the second slide member 9. As previously explained, the cylindrical members 11*a* and 11*b* are rotatable independently of each other. Thus, it is possible to prevent the roller 11 from being locked even if gypsum dust (gypsum powder) enters a region of the engagement among the casing 10, the first slide member 8, and the second slide member 9.

As previously explained, when the device body 4 is pressed against the workpiece, a screw 7 on the belt 17 is fed to the given position (the drivable position) directly facing the front end of the driver bit 6. As shown in FIG. 5, the stoppers 28 prevent the screw 7 from moving beyond the given position even if the device body 4 is vigorously pressed against the workpiece. The stoppers 28 serve to stop the screw 7 at the given position (the drivable position) within the screw passage 30.

Figure 16:
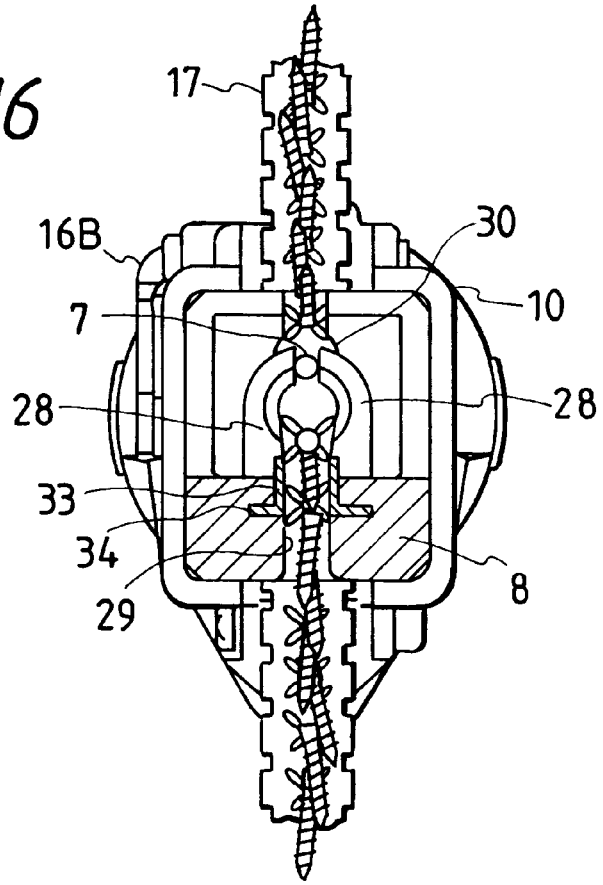
FIG. 16 is a sectional view, similar to FIG. 5, of the screw driving device in conditions different from conditions shown in FIG. 5.

The screw carrying belt 17 can be removed from the screw driving device as follows. When the screw carrying belt 17 is pulled relative to the screw driving device along the direction of the feed thereof by a great force, screws 7 on the belt 17 force the stoppers 28 away from each other and move through the resulting gap between the stoppers 28 as shown in FIG. 16. Then, the screws 7 on the belt 17 move out of the screw driving device via the screw passage 29. After the screw carrying belt 17 with the screws 7 is separated from the screw driving device, the stoppers 28 return to their original shapes.

Figure 17:
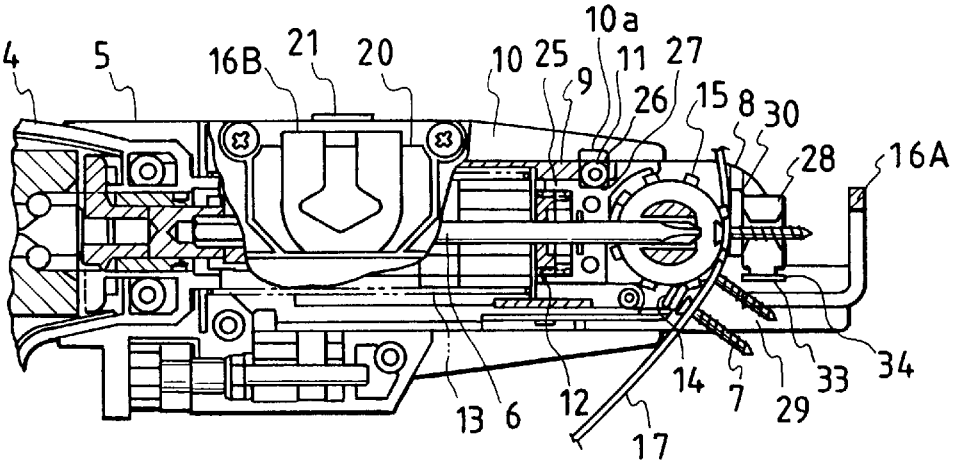
FIG. 17 is a sectional view of a part of the screw driving device in FIG. 3.
Figure 18:
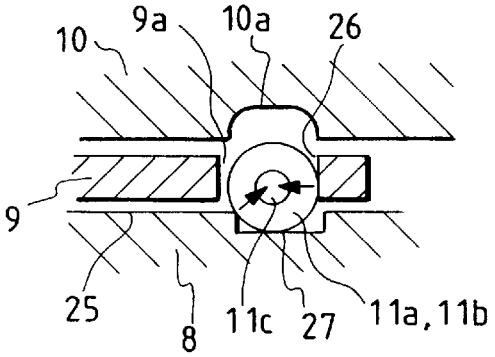
FIG. 18 is a sectional view, similar to FIG. 15, of the first slide member, the second slide member, the casing, and the roller in conditions different from conditions shown in FIG. 15.

When a screw 7 on the belt 17 is fed to the given position directly facing the front end of the driver bit 6 as shown in FIG. 17, a groove 27 in the first slide member 8 which extends in front of the flat portion 25 thereof reaches an area directly below the roller 11. Thus, as shown in FIG. 18, the roller 11 moves down out of the engagement groove 10*a* in the casing 10 and falls into the groove 27 in the first slide member 8. In this case, a major part of the roller 11 extends into the space 9*a* in the second slide member 9. Therefore, the second slide member 9 moves out of engagement with the casing 10 and falls into engagement with the first slide member 8. Then, the first slide member 8 and the second slide member 8 are moved rearward together.

Figure 19:
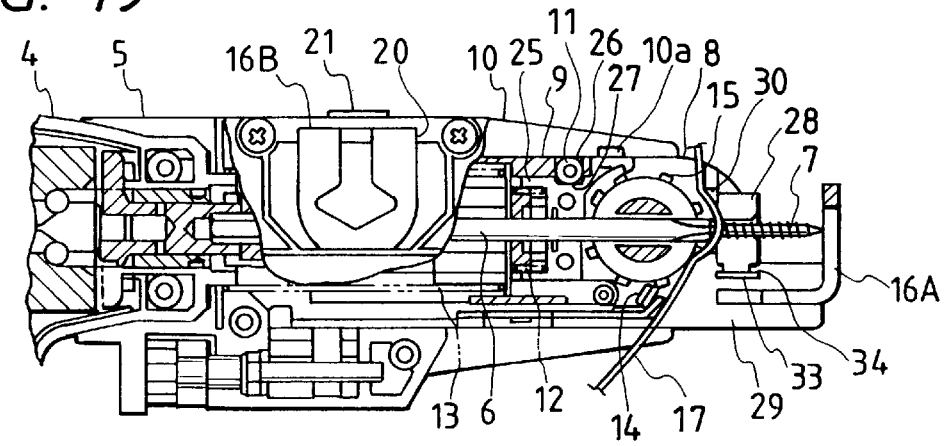
FIG. 19 is a sectional view, similar to FIG. 17, of the part of the screw driving device in conditions different from conditions shown in FIG. 17.

When the first slide member 8 and the second slide member 9 are further moved rearward, the front end of the driver bit 6 comes into engagement with the head of the screw 7 on the belt 17 which is in the given position (the drivable position) as shown in FIG. 19. At the same time, the screw carrying belt 17 is pressed against inner surfaces of the first slide member 8. As the first slide member 8 is further moved rearward, the screw carrying belt 17 receives a shearing load from the first slide member 8 and the screw 7.

As shown in FIGS. 4 and 19, the screw passage 30 in the first slide member 8 starts from its lower semicircular edge region which adjoins the screw passage 29 and which is axially in front of the driver bit 6. The lower semicircular edge region of the screw passage 30 contains the given position (the drivable position) of the screw 7. The screw passage 30 is elongated in the direction of the feed of the screw carrying belt 17. The screw passage 30 has a width corresponding to the width or the diameter of its semicircular edge regions. Therefore, the shearing load concentrates on the part of the screw carrying belt 17 above the screw 7 in the given position as viewed in FIG. 19. Thus, the shearing load significantly deforms this part of the screw carrying belt 17. As shown in FIG. 4, the screw carrying belt 17 has four radially-extending cuts 31 around each screw 7. The screw carrying belt 17 starts to tear from the two cuts in an upper side of the screw 7 in the given position due to the shearing load. Accordingly, the screw 7 is separated from the belt 17 by a relatively small load. As shown in FIG. 4, the distances between the head of the screw 7 and the first slide member 8 are relatively small in sidewise directions and a rearward direction with respect to the direction of feed of the screw carrying belt 17. On the other hand, the distance between the head of the screw 7 and the first slide member 8 is relatively great in the direction of the feed of the screw carrying belt 17. The screw 7 is driven into the work piece while being forced frontward and being rotated by the driver bit 6. During the driving of the screw 7 into the workpiece, the screw carrying belt 17 is adequately supported by portions of the first slide member 8 which extend in the sidewise directions and the rearward direction from the screw 7 with respect to the direction of feed thereof. Thus, during the driving of the screw 7 into the workpiece, it is possible to prevent the screw carrying belt 17 from separating from the first slide member 8.

Generally, after the screw 7 has been completely driven into the workpiece, the operator separates the device body 4 from the workpiece. When the device body 4 is separated from the workpiece, the spring 13 returns the first slide member 8 and the second slide member 9 to the positions of FIG. 17. Then, the spring 12 returns the first slide member 8 to its initial position.

When the first slide member 8 moves from the position of FIG. 17 toward its initial position, the roller 11 receives forces, denoted by arrows in FIG. 18, from the first slide member 8 and the second slide member 9. Specifically, the roller 11 is pressed between the rear edge of the groove 27 in the first slide member 8 and the surface 26 of the stepped wall of the second slide member 9 which defines the front side of the space 9*a*. At this time, the central cylindrical member 11*a* of the roller 11 contacts the surface 26 of the stepped wall of the second slide member 9 which defines the front side of the space 9*a*. On the other hand, the side cylindrical members 11*a* of the roller 11 contact the rear edge of the groove 27 in the first slide member 8. The central part of the rear edge of the groove 27 in the first slide member 8 is stepped back so that the rear edge of the groove 27 will be out of contact with the central cylindrical member 11*b* of the roller 11. The force applied to the roller 11 from the first slide member 8 is in a direction so as to rotate the roller 11 counterclockwise as viewed in FIG. 18. On the other hand, the force applied to the roller 11 from the second slide member 9 is in a direction so as to move the roller 11 rearward. The side cylindrical members 11*a* of the roller 11 bear the load from the first slide member 8 while the central cylindrical member 11*b* of the roller 11 bears the load from the second slide member 9. As previously explained, the cylindrical members 11*a* and 11*b* are rotatable independently of each other. Thus, it is possible to prevent the roller 11 from being locked even if gypsum dust (gypsum powder) enters a region of the engagement between the first slide member 8 and the second slide member 9 via the roller 11. Preferably, the width of the engagement groove 10*a* in the casing 10 is greater than a corresponding dimension of the roller 11 so that gypsum dust can easily escape from the engagement groove 10*a*.

A further explanation will be given of the separation of a screw 7 from the belt 17 before the driving of the screw 7 into the workpiece. As the driver bit 6 forces a screw 7 on the belt 17 frontward, the belt 17 moves together with the screw 7 until the belt 17 meets inner surfaces of the first slide member 8 around the screw passage 30. During this period, portions of the belt 17 around the screw 7 receive equal loads. In general, stronger forces are necessary to deform the portions of the belt 17 around the screw 7 which correspond to the sidewise directions and the rearward direction with respect to the feed of the belt 17 since the distances between the head of the screw 7 and the first slide member 8 are relatively small in these directions. On the other hand, a weaker force can deform the portion of the belt 17 near the screw 7 which corresponds to the forward direction with respect to the direction of feed of the belt 17 since the distance between the head of the screw 7 and the first slide member 8 is relatively great in this direction.

As a result of the above-indicated relation between the forces, the screw 7 slightly slides in the forward direction with respect to the direction of feed of the belt 17. The slide of the screw 7 shears or breaks the portion of the belt 17 near the screw 7 which corresponds to the forward direction with respect to the direction of feed of the belt 17. During a subsequent period of time, as the driver bit 6 forces the screw 7 frontward, a break occurs in the portion of the belt 17 near the screw 7 which corresponds to the rearward direction with respect to the direction of feed of the belt 17. Thus, the screw 7 is separated from the belt 17.

Second Embodiment

Figure 20:
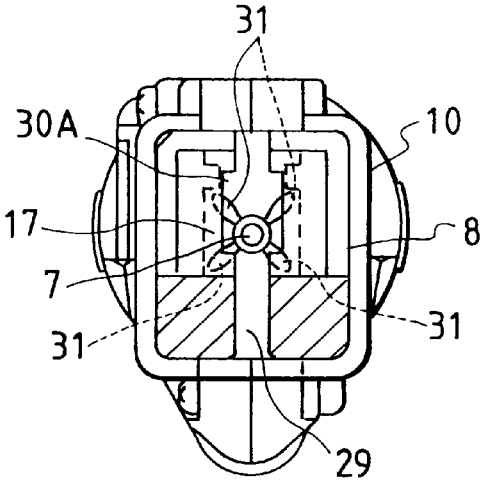
FIG. 20 is a sectional view of a screw driving device according to a second embodiment of this invention.

FIG. 20 shows a second embodiment of this invention which is similar to the embodiment of FIGS. 3–19 except for a design change indicated hereinafter. The embodiment of FIG. 20 has a screw passage 30A instead of the screw passage 30 in the embodiment of FIGS. 3–19. The screw passage 30A has a polygonal cross-section such as a rectangular cross-section.

Third Embodiment

Figure 21:
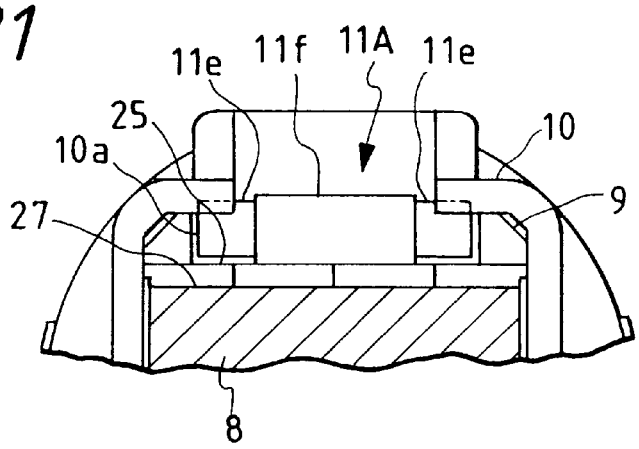
FIG. 21 is a sectional view of a part of a screw driving device according to a third embodiment of this invention.
Figure 22:
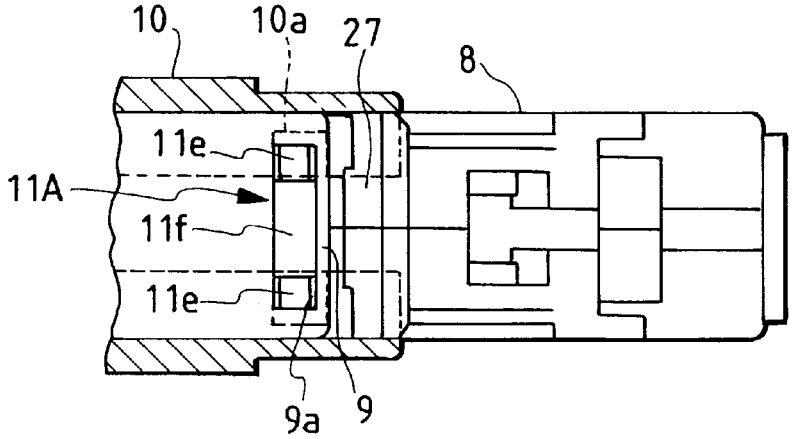
FIG. 22 is a sectional view of a part of the screw driving device in FIG. 21.

FIGS. 21 and 22 show a third embodiment of this invention which is similar to the embodiment of FIGS. 3–19 except for a design change indicated hereinafter. The embodiment of FIGS. 21 and 22 has a roller 11A instead of the roller 11 in the embodiment of FIGS. 3–19.

The roller 11A has axially-aligned cylindrical members 11*e* and 11*f*. The cylindrical members 11*e* are located at opposite sides of the cylindrical member 11*f*. The cylindrical members 11*e* and 11*f* are rotatable about a common needle independently of each other. The outside diameter of the central cylindrical member 11*f* is greater than the outside diameter of the side cylindrical members 11*e*.

What is claimed is:

1. A device for sequentially driving screws carried on a screw carrying belt, comprising:

a rotatable driver bit for driving a screw into a workpiece;

a motor for rotating the driver bit;

a rotatable sprocket in engagement with the screw carrying belt for feeding the screw carrying belt and for feeding a screw on the screw carrying belt to a drivable place axially aligned with and being in front of the driver bit; and a slide member for supporting the screw carrying belt, the slide member having a hole through which the screw is driven into the workpiece by the driver bit, said hole having first and second opposite pairs of edges perpendicular to a driving axis;

wherein when the screw is in the drivable place, a distance between the screw and said first edges of the hole is greater than a distance between the screw and said second edges of the hole.

2. A device as recited in claim 1, wherein the first edges extend along a direction of feed of the screw carrying belt by the sprocket.

3. A device as recited in claim 2, wherein the first edges extend along a direction of outgoing movement of the screw carrying belt.

4. A device as recited in claim 1, further comprising a stopper for stopping a screw on the screw carrying belt at the drivable place, the stopper being provided on the slide member and comprising divided elastic members which engage the screw in the drivable place.

5. A device for sequentially driving screws carried on a screw carrying belt, comprising:

a rotatable driver bit for driving a screw into a workpiece;

a motor for rotating the driver bit;

a rotatable sprocket in engagement with the screw carrying belt for feeding the screw carrying belt and for feeding a screw on the screw carrying belt to a predetermined drivable place axially aligning with and being in front of the driver bit; and a slide member for supporting the screw carrying belt, the slide member being slidable relative to the driver bit, the slide member having a groove along which bodies of screws on the screw carrying belt travel as the screw carrying belt is fed by the sprocket;

wherein the groove has a first portion and a second portion in communication with each other, and screws on the screw carrying belt move from the first portion to the second portion as the screw carrying belt is fed by the sprocket; and wherein an edge region of the second portion which adjoins the first portion contains the predetermined drivable place of the screw, the second portion being elongated from the edge region along a direction of feed of the screw carrying belt by the sprocket, the second portion being greater in width than the first portion, whereby a relatively small shearing force is required to separate a screw from the screw carrying belt when the driver bit is engaged with the screw to drive it into a workpiece; and a stopper for stopping a screw on the screw carrying belt at the predetermined drivable place, the stopper being provided on the slide member and comprising divided elastic members which engage the screw in the predetermined drivable place.

* * * * *